US005878908A

United States Patent [19]

Foley

[11] Patent Number: 5,878,908

[45] Date of Patent: Mar. 9, 1999

[54] SUPPLEMENTAL FEEDING CUP FOR INFANTS

[76] Inventor: Mark Foley, 6232 Paradise Ter., Carp Lake, Mich. 49718

[21] Appl. No.: 948,367

[22] Filed: Oct. 9, 1997

[51] Int. Cl.[6] ..... B65D 25/04

[52] U.S. Cl. ..... 220/575; 220/501; 220/703; 220/556; 220/505

[58] Field of Search ..... 220/501, 556, 220/555, 575, 23.8, 703, 505, 507, 553, 717, 574

[56] References Cited

U.S. PATENT DOCUMENTS

| | | | |
|---|---|---|---|
| 258,777 | 5/1882 | Leonard | 220/501 |
| 2,550,568 | 4/1951 | Kersh | 128/252 |
| 2,599,919 | 6/1952 | Hucknall | 65/13 |
| 2,652,701 | 9/1953 | Longhurst | 220/703 |
| 2,792,696 | 5/1957 | Stayart | 65/13 |
| 2,843,287 | 7/1958 | Finley | 220/575 |
| 2,927,708 | 3/1960 | Kristoffersen | 215/11 |
| 3,116,152 | 12/1963 | Smith | 220/501 |
| 3,223,127 | 12/1965 | Sidebottom | 220/501 |
| 4,801,027 | 1/1989 | Hunter | 215/11.1 |
| 5,176,282 | 1/1993 | Rapaz | 220/575 |
| 5,405,030 | 4/1995 | Frazier | 220/556 |

FOREIGN PATENT DOCUMENTS

| | | | |
|---|---|---|---|
| 2265816 | 10/1993 | United Kingdom | 220/501 |

*Primary Examiner*—Stephen Castellano
*Attorney, Agent, or Firm*—Henderson & Sturm

[57] ABSTRACT

A supplemental feeding cup 10 for infants wherein the feeding cup 10 comprises a main receptacle member 20 having an internal channel 27 formed in the front wall 25 of the receptacle member 20. The internal channel 27 is in open fluid communication with an auxiliary reservoir member 30 projects outwardly from the front wall 25 of the receptacle member 20.

3 Claims, 2 Drawing Sheets

SUPPLEMENTAL FEEDING CUP FOR INFANTS

CROSS REFERENCE TO RELATED APPLICATIONS

Not applicable.

STATEMENT REGARDING FEDERALLY SPONSORED RESEARCH

OR DEVELOPMENT

Not applicable.

REFERENCE TO MICROFICHE APPENDIX

Not applicable.

BACKGROUND OF THE INVENTION

1. Field of the Invention

The present invention relates to the field of drinking cups in general, and in particular to a supplemental feeding cup for infants.

2. Description of Related Art

As can be seen by reference to the following U.S. Pat. Nos. 2,550,568; 2,599,919; 2,792,696; 2,927,708; and 4,801,027, the prior art is replete with myriad and diverse drinking cup receptacles.

While all of the aforementioned prior art constructions are more than adequate for the basic purpose and function for which they have been specifically designed, they are uniformly deficient with respect to their failure to provide a simple, efficient, and practical cup construction for the supplemental feeding of breast fed infants.

As any breast feeding mother is aware, there are certain occasions where it is necessary to employ supplemental feeding techniques in order to insure that the baby is receiving proper nourishment.

In addition, virtually all existing cup constructions are either too small or too wide to allow the parent to monitor the feeding process and they also tend to create nipple confusion for the infants.

As a consequence of the foregoing situation, there has existed a longstanding need for a new and improved cup construction for the supplemental feeding of babies wherein the cup construction not only minimizes nipple confusion for the infant, but simplifies the supplemental feeding for both the babies and the parents and the provision of such a construction is a stated objective of the present invention.

BRIEF SUMMARY OF THE INVENTION

Briefly stated, the supplemental feeding cup for infants which forms the basis of the present invention comprises a main receptacle unit having an auxiliary reservoir unit extending outwardly relative to the front of the receptacle unit.

As will be explained in greater detail further on in the specification, the receptacle unit is provided with an internal channel that is in open fluid communication with the interior of the auxiliary reservoir unit wherein a discrete amount of liquid may be delivered from the receptacle unit to the reservoir unit.

In addition, the auxiliary reservoir unit is designed and configured to hold a discrete amount of liquid such as breast milk or the like and facilitate the ingestion of the liquid by the sipping action of the infant so as to preclude nipple confusion on the part of the infant.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
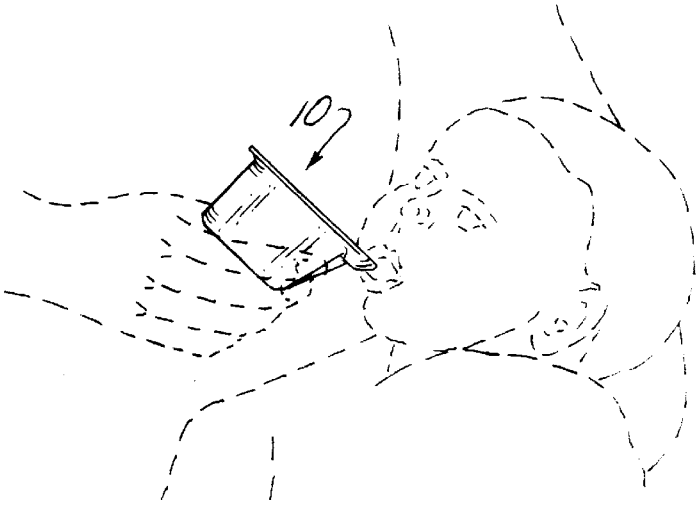
FIG. 1 is a perspective view of the supplemental feeding cup for infants that forms the basis of the present invention.
Figure 2:
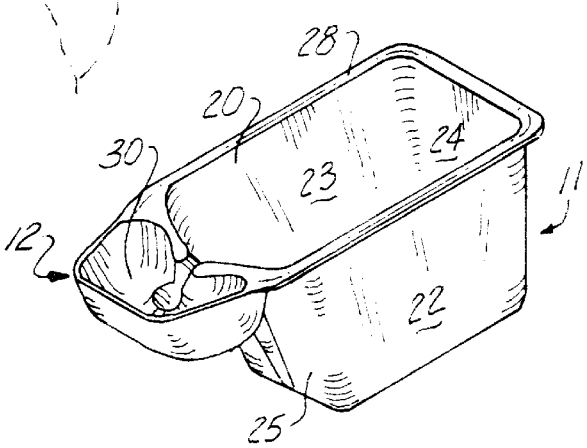
FIG. 2 is another perspective view of the feeding cup.

As can be seen by reference to the drawings, and in particularly to FIG. 2, the supplemental feeding cup for infants that forms the basis of the present invention is designated generally by the reference number 10. The feeding cup 10 comprises in general a main receptacle unit 11, and an auxiliary reservoir unit 12 which projects outwardly from one end of the main receptacle unit 11. These units will now be described in seriatim fashion.

As shown in FIGS. 2 through 7, the main receptacle unit 11 comprises a receptacle member 20 having a generally elongated rectangular base portion 21 surrounded by a pair of vertical side walls 22, 23, a vertical rear wall 24 and an angled front wall 25 provided with an outwardly projecting ridge 26 which forms an internal channel 27 on the interior of the angled front wall 25 of the receptacle member 20. In addition, the receptacle member 20 is further provided with a peripheral lip portion 28 to assist the parent in gripping the receptacle member 20 during feedings.

Turning now to FIGS. 2 through 6, it can be seen that the auxiliary reservoir unit 12 is formed as an extension to the vertical side walls 22, 23 and the angled front wall 25 of the receptacle member 20. The auxiliary reservoir unit 12 comprises auxiliary reservoir member 30 provided with smooth rounded edges 31 and cooperates with a pair of raised rear wall portions 32, 33 which are separated from one another by the internal channel 27 in the angled front wall 25 of the receptacle member 20 to define a discrete shallow reservoir 34 whose purpose and function will be described presently.

Figure 5:
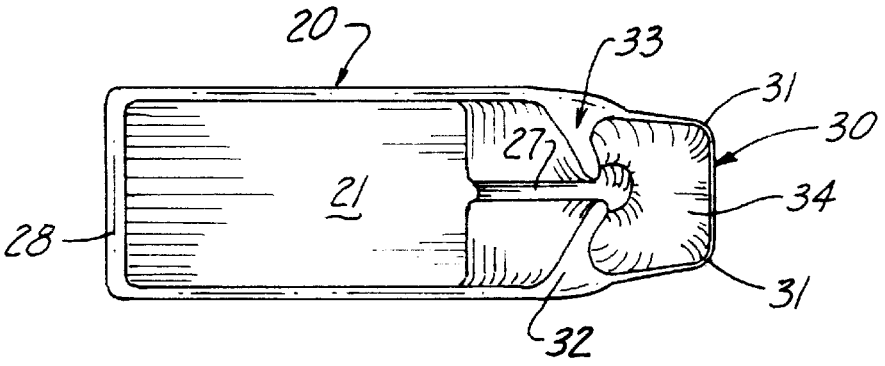
FIG. 5 is a top plan view.
Figure 7:
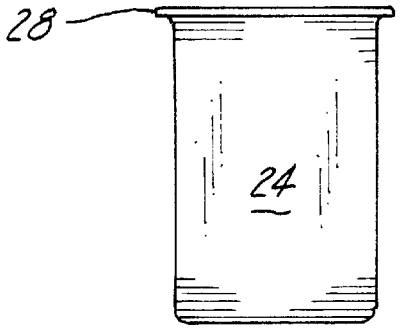
FIG. 7 is a rear plan view.
Figure 6:
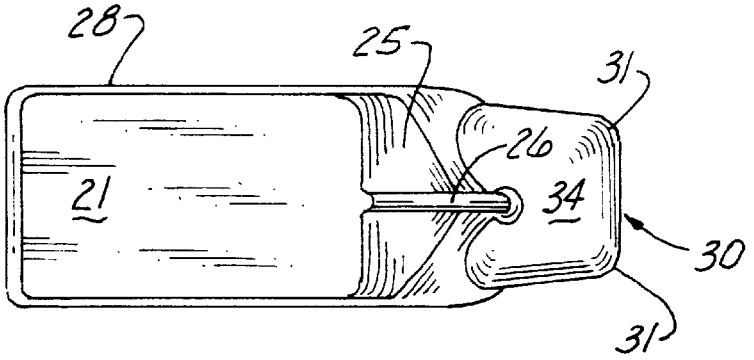
FIG. 6 is a bottom plan view.

As can best be appreciated by reference to FIGS. 2, 5, and 6, the internal channel 27 is disposed intermediate the raised rear wall portions 32, 33 of the reservoir member 30 and establishes direct fluid communication between the main receptacle member 20 and the auxiliary reservoir member 30 which is disposed in a generally cantilevered fashion relative to the front portion of the main receptacle member 20.

Figure 3:
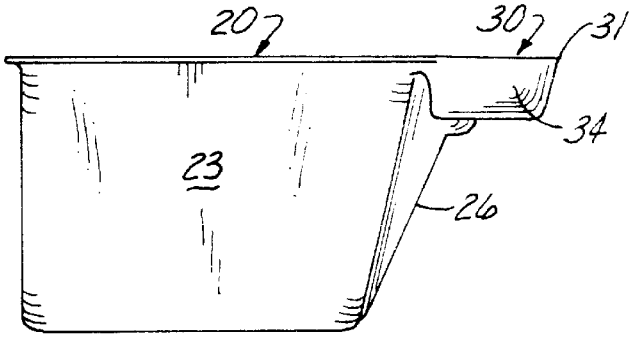
FIG. 3 is a side plan view of the feeding cup.
Figure 4:
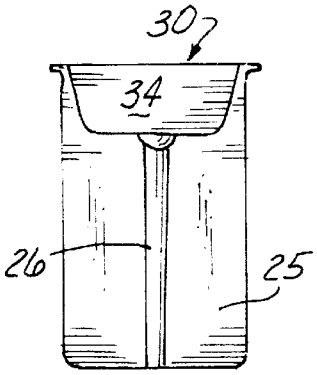
FIG. 4 is a front plan view.

By now it should be appreciated that the supplemental feeding cup 10 of this invention provides a shallow reservoir 34 that is suspended in a cantilevered fashion relative to the main receptacle member 20 wherein the liquid contents of the main receptacle member 20 may be delivered to the shallow reservoir 34 via the internal channel 27 formed in the front wall 25 of the receptacle member 20 by tilting the feeding cup 10 in a clockwise rotation as viewed in FIG. 3.

It should also be appreciated at this juncture that the elongated configuration of the main receptacle member 20 and the peripheral lip portion 28 facilitates a parent's grasp on the main receptacle member 20. The tapered and rounded configuration of the corners 31 of the auxiliary reservoir member 30 facilitates the sipping of the contents of the shallow reservoir 34 by an infant.

In addition, this construction allows the parents to closely monitor the volume of liquid that is being delivered from the main receptacle member 20 to the auxiliary reservoir member 30 due to the narrower width of the auxiliary reservoir member 30 relative to the main receptacle member 20, as well as the limited fluid capacity of the auxiliary reservoir member 30.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A supplemental feeding cup for infants wherein the feeding cup comprises:

a receptacle unit including an enlarged main receptacle member having a base portion, a pair of side walls, a rear wall, and a forwardly angled front wall; and an auxiliary reservoir unit extending outwardly from the top of the front wall of the receptacle member wherein the auxiliary reservoir unit comprises a substantially smaller auxiliary reservoir member having a generally flat bottom, inwardly angled sides, a front wall portion, and a rear wall portion wherein said front wall of the receptacle member is provided with an elongated internal channel that is in open communication with the interior of the auxiliary reservoir member through said rear wall portion.

2. The feeding cup as in claim 1 wherein the top of the rear wall portion is disposed proximate the top of the main receptacle member.

3. The feeding cup as in claim 1 wherein said elongated internal channel defines a rib which projects forwardly of the remainder of the angled front wall of the main receptacle member.

* * * * *